US005083443A

United States Patent [19]

von Blanquet

[11] Patent Number: 5,083,443

[45] Date of Patent: Jan. 28, 1992

[54] ADJUSTABLE RECESSED BASE OF A REFRIGERATOR OR FREEZER

[75] Inventor: Georg von Blanquet, Baden-Baden, Fed. Rep. of Germany

[73] Assignee: Gaggenau-Werke Haus-und Lufttechnik GmbH, Gaggenau, Fed. Rep. of Germany

[21] Appl. No.: 657,820

[22] Filed: Feb. 20, 1991

[30] Foreign Application Priority Data

Feb. 22, 1990 [DE] Fed. Rep. of Germany ... 9002083[U]

[51] Int. Cl.[5] ..... F25D 17/06

[52] U.S. Cl. ..... 62/428; 62/508

[58] Field of Search ..... 62/428, 454, 455, 508, 62/440; 98/121.1

[56] References Cited

U.S. PATENT DOCUMENTS 4,821,530 4/1989 Ledbetter ..... 62/440

*Primary Examiner*—Albert J. Makay
*Assistant Examiner*—John Sollecito
*Attorney, Agent, or Firm*—Wenderoth, Lind & Ponack

[57] ABSTRACT

A refrigerator and/or freezer for installation into a row of kitchen units has a door and a recessed base below the door, the recessed base being adapted to accommodate variable heights of the recessed base relative to the floor supporting the refrigerator/freezer and variable amounts of recession relative to the door. A main ventilation channel and two side ventilation channels are defined in the recessed base. The cooling unit is disposed in the recessed base and has compressors, a condenser and a fan for circulating air through the main ventilation channel and the side channels. An adjustable ventilation grille is disposed on the front portion of the ventilation channels by two fixed inner wall sections and two side wall sections movably supported on the fixed inner wall sections. The ventilation grille is mounted so as to be both vertically adjustable in discrete steps on the recessed base, as well as horizontally adjustable to adjust the amount of recession of the base. The mounting of the side wall sections to the fixed inner wall sections allow for horizontal adjustment, while the mounting of the ventilation grill to the side wall sections allows for vertical adjustment.

15 Claims, 1 Drawing Sheet

ADJUSTABLE RECESSED BASE OF A REFRIGERATOR OR FREEZER

BACKGROUND OF THE INVENTION

1. Field of the Invention

The present invention relates to a cooling device such as a refrigerator or freezer for installation in a row of kitchen units. Below a door of the refrigerator or freezer there is a recessed base forming between its lower, bottom surface and an upper base separating wall a ventilation channel for a cooling unit. Such a cooling unit comprises a compressor, condenser and fan. The ventilation channel has a front opening covered with an adjustable ventilation grille, and the base is designed to be adaptable to variable base heights from the floor or other supporting surface of the refrigerator or freezer and to a variable amount of recess.

2. Description of the Prior Art

In either refrigerators or freezers, or combined refrigerators and freezers, designs are known wherein the cooling unit is arranged completely in the base of the refrigerator/freezer. The base has the condenser of the cooling unit, as well as a ventilation fan, disposed therein. A ventilation channel in the base ventilates the condenser.

With the above type of arrangement, the cooling device, i.e. refrigerator and/or freezer, can be set up directly against a wall. Such a feature is not possible when a lamellar condenser is attached to the rear wall of the cooling device, due to the necessary air flow gap between the wall and the lamellar condenser. When installing a cooling device into a row of kitchen units, it is necessary to adjust the base of the cooling device both in terms of height and in terms of the amount the base is desired to be recessed. At the same time the ventilation grille covering the inlet and outlet openings of the ventilation channel must be adjusted in accordance with the height and depth of the recessed base. Only in this manner can the cooling device be neatly fitted into the row of kitchen units.

A cooling device of the above type is disclosed in German application DE-GM 82 10 690. In this disclosure, a ventilation channel is provided in the base, the base being recessed with respect to the door of the cooling device on the front of the cooling device. The base is covered on this side with a baffle, i.e. a ventilation grille. In order to adjust the height of the ventilation grille to the desired height of the recessed base, edge strips can be severed from the rectangular ventilation grille at predetermined separation points. Thus, starting from a maximum height, it is possible to adjust, step-by-step, to a set base height. However, the adjustment having once been made cannot be reversed; i.e. the ventilation grille cannot be adjusted for an increase in the base height from whatever size it has been reduced to. For adjustment of the ventilation grille to variable base recesses, the ventilation grille is mounted on flanged side wall sections which can be moved horizontally and clamped into slotted connections. Adjusting the slotted connections produces an adjustment in the amount of the recess of the ventilation grille.

Also known from European application EP-A 0 190 794 is a refrigerator which has a base with an air guide in the interior of the base. Cooling air is introduced into and blown out of the base and flows in a reversing flow between a right and left sub-region. This arrangement is also provided with baffles or ventilation grilles which can be cut to fit the height of the base.

The above-noted arrangements of the prior art do not enable an exact guide of the air entering the base irrespective of the position of the ventilation grille. Also, the arrangements for adapting the ventilation grille to variable base heights and to variable base recesses either involve too much time being consumed or are not sufficiently flexible.

The object of the present invention is to provide a cooling device such as a refrigerator or freezer of the above-discussed type wherein air is guaranteed to be exactly guided in any position of the ventilation grille on the recessed base. A further object of the present invention is to enable the adjustment of the ventilation grille, in particular the adjustment of the height of the ventilation grille with respect to the recessed base, in a simpler and easier manner than in the prior art.

SUMMARY OF THE INVENTION

The above-discussed objects of the invention are achieved by the present invention, providing a cooling device having a cooling compartment with a door and a recessed base below the door adapted to variable heights of the recessed base relative to the support surface of the cooling device and variable amounts of recess of the recessed base relative to the door.

The recessed base includes a plurality of wall members which define the recessed base below the cooling compartment. The recessed base has one open side and a wall arrangement for defining ventilation channels in the recessed base. The ventilation channels have both an air inlet and outlet at the open side of the recessed base.

Cooling equipment forming a cooling unit for cooling the cooling compartment is disposed in the recessed base for ventilation by air passing through its ventilation channels. A ventilation grille covers the open side of the recessed base, and is mounted by a first arrangement which mounts the ventilation grille to the recessed base so that the ventilation grille can be vertically moved in discrete steps relative to the recessed base and a second mounting arrangement mounting the ventilation grille to the recessed base so that the ventilation grille can be horizontally adjusted relative to the recessed base.

More preferably, the ventilation grille comprises a plurality of vertically superposed elongated members which have a right angle cross-section.

Preferably, the first mounting arrangement includes a pair of side wall sections, each of the side wall sections having a plurality of rectangular projections thereon. The elongated members of the ventilation grille rest on the rectangular projections. More preferably, the plurality of rectangular projections extend in vertical rows on respective side wall sections, whereby the ventilation grille is vertically adjustable along the rows of projections. The second mounting arrangement includes a slot connection between the side wall sections and the wall arrangement, whereby the side wall sections, and thus the ventilation grille, can be horizontally moved relative to the recessed base by adjusting the slot connections.

Also, the cooling equipment of the cooling unit preferably includes a condenser disposed in the ventilation channels, a compressor disposed in the ventilation channels and a fan for moving air through the ventilation channels.

Furthermore, the above-discussed objects of the present invention are further achieved by providing a cooling device for installation into a row of kitchen units, the cooling device having a door and a recessed base below the door, and the recessed base being adapted to accommodate variable heights of the recessed base relative to a support surface of the cooling device as well as variable amounts of recession relative to the door.

The recessed base includes a bottom, an upper base separating wall and a plurality of base side walls forming a ventilation channel therebetween. A cooling unit in the recessed base comprises at least one compressor, a condenser and a fan. An adjustable ventilation grille is disposed at a front portion of the ventilation channel in the recessed base. Further, two fixed inner wall sections are provided in the ventilation channel. Two side wall sections are movably supported by respective fixed inner wall sections, the adjustable ventilation grille being supported by the two side wall sections.

The fixed inner wall sections and their respective side wall sections form a main air guide channel therebetween having an inlet at the ventilation grille and an outlet, the condenser being disposed in the main air guide channel. The fan is disposed at the outlet of the main air guide channel. Furthermore, the base side walls, and the fixed inner wall sections and their respective side wall sections, form two partial flow channels guiding air from the main air guide channel in the opposite direction of the main air guide channel. At least one compressor is disposed in the flow of air of the partial flow channels.

Preferably, the adjustable ventilation grille is supported on the two side wall sections by an adjustable connection vertically ajustably connecting the ventilation grille to the two side wall sections so that the grille can be vertically adjusted in discrete steps relative to the two side wall sections in order to accommodate variable heights of the recessed base. Further, the ventilation grille preferably has a plurality of superposed elongated members having right angle cross-sections, and the side wall sections preferably have a plurality of rectangular projections, with the elongated members resting on the rectangular projections of the side wall sections.

Preferably, the side wall sections are movably supported on the fixed inner wall sections by slotted connections, enabling variable amounts of recession of the ventilation grille relative to the door.

Furthermore, there are preferably two of the compressors in respective flows of air of the partial flow channels.

The advantages of the above-discussed arrangements are that there results an exact, stable air guide which remains essentially unaffected, even when the ventilation grille is adjusted vertically as well as horizontally.

A preferable design uses the fan to suck cooling air through the ventilation grille through the main air guide channel at a central position of the recessed base and discharges the air through the two partial flow channels located outwardly of the main air guide channel through the ventilation grille. But note that an advantageous arrangement also results from guiding the air in the opposite directions to those discussed above.

Furthermore, it is noted that the ventilation grille is adjustable in a step wise manner, i.e. in discrete steps, on the projections of the side wall sections. To fix the ventilation grille at any particular step, the ventilation grille is merely placed on the desired projections and secured by means of one or more screw connections, as an example.

BRIEF DESCRIPTION OF THE DRAWINGS

The present invention will be explained below in further detail together with the accompanying drawings, in which.

DETAILED DESCRIPTION OF THE PREFERRED EMBODIMENT

Figure 2:
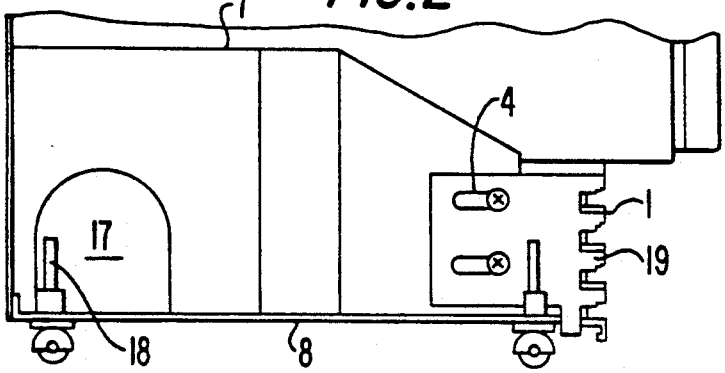
FIG. 2 is a schematic side view of a recessed base according to the present invention having a maximum amount of recession and minimum amount of base height.
Figure 3:
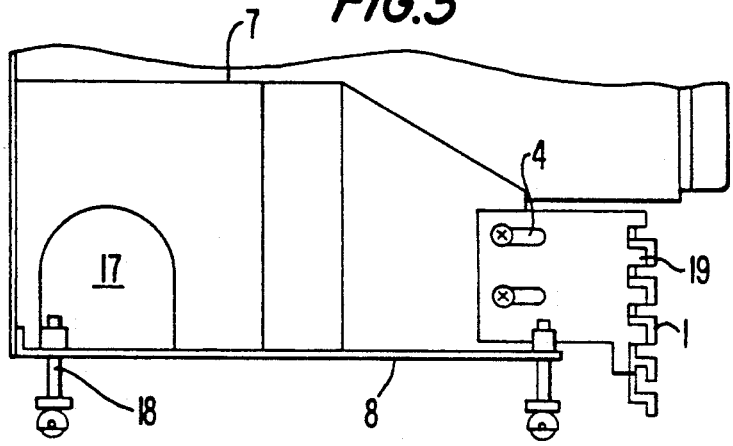
FIG. 3 is a schematic side view of the recessed base according to the present invention with a minimum amount of base recession and a maximum amount of base height.
Figure 1:
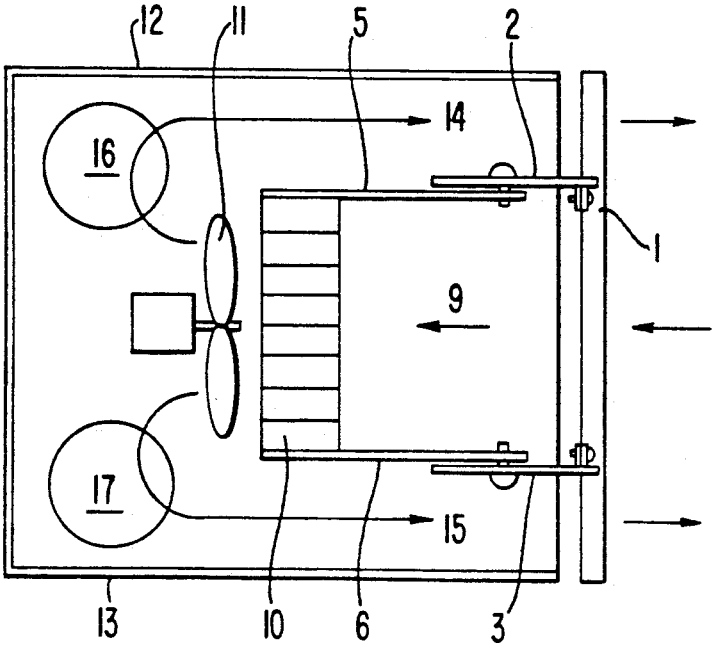
FIG. 1 is a schematic top view of the interior of a recessed base according to the present invention.

FIG. 1 illustrates a ventilation grille 1 made up of a plurality of elongated members having a right angle cross-section. The ventilation grille 1 is supported by two side wall sections 2 and 3. The side wall sections 2 and 3 are connected by means of slotted connections 4 as illustrated in FIGS. 2 and 3 to respective fixed inner wall sections 5 and 6. The recessed base of the present invention is defined by an upper base separating wall 7 and a bottom section 8, along with side walls 12 and 13. The inner wall sections 5 and 6, together with their respective side wall sections 2 and 3, define, along with upper base separating wall 7 and bottom section 8, a main air guide channel 9, as illustrated in FIG. 1. In the embodiment illustrated, main air guide channel 9 is designed as an inflow channel having an inlet adjacent an open side of the base. Air flows into the main air guide channel 9 through the central region of the ventilation grille 1.

A lamellar condenser 10 is disposed in the main air guide channel 9, as illustrated in FIG. 1. A fan 11 is also disposed in the base, and causes the forced movement of air through the main air guide channel 9 for forced ventilation of the lamellar condenser 10.

The fixed inner wall sections 5 and 6, together with their respective side wall sections 2 and 3, define with the side walls of the base 12 and 13 partial flow channels 14 and 15. The cooling air is reversed in direction inside the base and flows in the opposite direction of the main air guide channel 9 through the partial flow channels 14 and 15, to be discharged through the outer regions of the ventilation grille 1 in the directions of the arrows as illustrated in FIG. 1.

Note that compressors 16 and 17 are disposed inside the base. Preferably, these compressors are disposed so as to be in respective partial flow channels, as illustrated in FIG. 1.

Also note the use of bottom set screws 18 to adjust the height of the base, and thus the overall cooling device, relative to the floor or other support surface.

Figure 4:
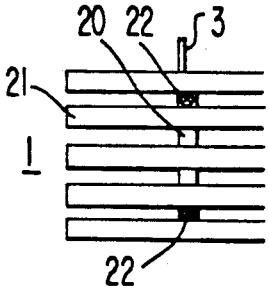
FIG. 4 is a schematic front view illustrating the attachment of a ventilation grille of the recessed base according to the present invention.

Noting in particular FIGS. 2–4, each side wall section 2 and 3 has a plurality of rectangular projections 19 extending from the forward edge thereof. These projections 19 allow the right angle elongated members of the ventilation grille 1 to be disposed thereon as illustrated in FIGS. 2 and 3.

Furthermore, the ventilation grille, as seen in FIG. 4, has connection members 20 attached thereto for securing the ventilation grille 1 to the respective side wall sections 2 and 3. The elongated and vertically superposed right angle cross section members 21 of the ventilation grille are attached to the connection members 20. Holding screws 22 as illustrated in FIG. 4 are preferably used to secure the connection members 20 to their respective side wall sections 2 and 3. As illustrated in FIG. 1, but not labelled with a reference number, the respective side wall sections 2 and 3 may have further projections suitable for the holding screws 22.

In FIG. 2, the two side wall sections 2 and 3 are moved to the furthest recessed position in the slot connections 4. The ventilation grille 1 has been placed on the rectangular projections 19 of the side wall sections 2 and 3 at its upper most position. This adjustment of the ventilation grille corresponds to a maximum recess and a minimum base height.

FIG. 3 illustrates the side wall sections 2 and 3 pulled out as far as possible, and thus with a minimum base recess, on their slot connections 4. Since in this arrangement an (approximately) maximum base height is indicated by the adjustments of the bottom set screws 18, the ventilation grille 1 has been adjusted downward by moving the elongated members 21 downward on the rectangular projections 19 of the side sections 2 and 3. The ventilation grille 1 still covers the front side of the base, and merely extends to the floor or support surface of the cooling device.

It is of course clear that intermediate positions are possible between the two extreme positions illustrated in FIGS. 2 and 3. When the ventilation grille 1, supported on the side wall sections 2 and 3, is moved horizontally, the intermediate positions are essentially continuous. The vertical adjustment is made stepwise, by the distance of the height of each of the rectangular projections 19 at each step. The adjustment of the ventilation grille 1 with respect to both the base height and the amount of recess leaves the flow ratios with respect to the main air guide channel 9 and the two partial flow channels 14 and 15 essentially unaffected.

I claim:

1. A cooling device unit for installation into a row of kitchen units, the cooling device having a door and a recessed base below said door, said recessed base being adapted to accommodate variable heights of said recessed base relative to a support surface of said cooling device and variable amounts of recession relative to said door, said recessed base including:

a bottom, an upper base separating wall and a plurality of base side walls forming a ventilation channel therebetween;

a cooling unit in said recessed base comprising at least one compressor, a condenser and a fan;

an adjustable ventilation grille disposed at a front portion of said ventilation channel;

to fixed inner wall sections in said ventilation channel;

two side wall sections movably supported on respective said fixed inner wall sections, said adjustable ventilation grille being supported by said two side wall sections;

wherein said fixed inner wall sections and their respective said side wall sections form a main air guide channel therebetween having an inlet at said ventilation grille and an outlet and said condenser is disposed in said main air guide channel;

wherein said fan is disposed at said outlet of said main air guide channel;

wherein said base side walls, and said fixed inner wall sections and their respective said side wall sections, form two partial flow channels guiding air from said main air guide channel in the opposite direction of said main air guide channel, said at least one compressor being disposed in the flow of air of said partial flow channels.

2. The cooling unit of claim 1, wherein:

said adjustable ventilation grille is supported on said two side wall sections by an adjustable connection means for vertically adjustably connecting said adjustable ventilation grille to said two side wall sections such that said grille can be vertically adjusted in discrete steps relative to said two side wall sections for accommodating variable heights of said recessed base.

3. The cooling unit of claim 2, wherein:

said ventilation grille comprises a plurality of superposed elongated members having a right angle cross-section; and said side wall sections have a plurality of rectangular projections, said elongated members resting on said rectangular projections.

4. The cooling unit of claim 1, wherein:

said side wall section are movably supported on said fixed inner wall sections by slotted connections for enabling variable amounts of recession of said ventilation grille relative to said door.

5. The cooling unit of claim 1, wherein there are two said compressors in respective flows of air of said partial flow channels.

6. A cooling device having a cooling compartment with a door and a recessed base below the door adapted for variable heights of said recessed base relative to the support surface of the cooling device and variable amounts of recession of said recessed base relative to the door, said recessed base including:

a plurality of wall members defining said recessed base below the cooling compartment, said recessed base having an open side;

wall means for defining ventilation channels in said recessed base, said ventilation channels having both an air inlet and air outlet at said open side of said recessed base;

cooling equipment for cooling said cooling compartment disposed in said recessed base for ventilation by air passing through said ventilation channels;

a ventilation grille covering said open side of said recessed base, said ventilation grille having first mounting means for mounting said ventilation grille to said recessed base such that said ventilation grille can be vertically moved in discrete steps relative to said recessed base and second mounting means for mounting said ventilation grille to said recessed base such that said ventilation grille can be horizontally adjusted relative to said recessed base.

7. The cooling unit of claim 6, wherein:

said ventilation grille comprises a plurality of vertically superposed elongated members having a right angle cross-section.

8. The cooling unit of claim 6, wherein:

said first mounting means comprises a pair of side wall sections, each said side wall section having a plurality of rectangular projections, and said elongated members resting on said rectangular projections.

9. The cooling unit of claim 8, wherein said plurality of rectangular projections extend in vertical rows on respective said side wall sections, whereby said ventilation grille is vertically adjustable along said rows of rectangular projections.

10. The cooling unit of claim 9, wherein said second mounting means comprises a slot connection between said side wall sections and said wall means, whereby said side wall sections, and thus said ventilation grille, can be horizontally moved relative to said recessed base by adjusting said slot connection.

11. The cooling unit of claim 10, wherein said wall means comprises a pair of walls fixed inside said recessed base and having respective said side wall sections connected thereto with respective said slot connections.

12. The cooling unit of claim 6, wherein said second mounting means comprises a slot connection between said wall means and said first mounting means.

13. The cooling unit of claim 12, wherein said first mounting means includes a pair of side wall sections, said side wall sections and said wall means having said slot connection therebetween.

14. The cooling unit of claim 13, wherein said wall means comprises a pair of walls fixed inside said recessed base and having respective said side wall sections connected thereto with respective said slot connections.

15. The cooling unit of claim 6, wherein said cooling equipment comprises a condenser disposed in said ventilation channels, a compressor disposed in said ventilation channels, and a fan for moving air through said ventilation channels.

* * * * *